United States Patent [19]

Falck et al.

[11] 4,260,983

[45] Apr. 7, 1981

[54] PRESENCE SENSING DETECTOR AND SYSTEM FOR DETECTING A RECEIVER/TRANSMITTER DEVICE AFFIXED TO AN ARTICLE

[75] Inventors: John B. Falck, London; Keith B. Glanvill; John N. Reid, both of Thorpe Bay, all of England

[73] Assignee: Tag Radionics Limited, Rochford, England

[21] Appl. No.: 2,866

[22] Filed: Jan. 11, 1979

[30] Foreign Application Priority Data

Jan. 11, 1978 [GB] United Kingdom ..... 1135/78

[51] Int. Cl.[3] ..... G08B 13/18

[52] U.S. Cl. ..... 340/572; 343/6.8 LC

[58] Field of Search ..... 340/572, 552, 551, 553; 343/6.8 R, 6.8 LC

[56] References Cited

U.S. PATENT DOCUMENTS

| | | | |
|---|---|---|---|
| 3,500,373 | 3/1970 | Minasy | 340/572 |
| 3,713,133 | 1/1973 | Nathans | 340/572 |
| 3,754,226 | 8/1973 | Fearon | 340/572 |
| 3,818,472 | 6/1974 | Mauk et al. | 340/572 |
| 3,859,624 | 1/1975 | Kriofsky et al. | 340/572 |
| 3,863,240 | 1/1975 | Galvin | 340/553 |
| 3,868,669 | 2/1975 | Minasy | 340/572 |
| 3,967,161 | 6/1976 | Lichtblau | 340/572 |
| 3,974,581 | 8/1976 | Martens et al. | 340/572 |
| 4,135,184 | 1/1979 | Pruzick | 340/572 |

FOREIGN PATENT DOCUMENTS

| | | |
|---|---|---|
| 311217 | 11/1973 | Austria . |
| 984581 | 2/1965 | United Kingdom . |
| 1129761 | 10/1968 | United Kingdom . |
| 1168509 | 10/1969 | United Kingdom . |
| 1187130 | 4/1970 | United Kingdom . |
| 1212504 | 11/1970 | United Kingdom . |
| 1406500 | 9/1975 | United Kingdom . |
| 1414990 | 11/1975 | United Kingdom . |
| 1447136 | 8/1976 | United Kingdom . |
| 1507050 | 4/1978 | United Kingdom . |

*Primary Examiner*—Glen R. Swann, III

*Attorney, Agent, or Firm*—Cushman, Darby & Cushman

[57] ABSTRACT

A presence sensing system comprises a detector having a transmitter for transmitting an interrogation signal to an area to be kept under surveillance and a receiver for receiving a presence indicating signal. A receiver/transmitter device the presence of which is to be detected is adapted to receive the interrogation frequency and to transmit a presence indicating signal in response thereto. A phase locked loop circuit has a first input coupled with the output of the receiver a second input for a reference signal, and an output for providing a phase locked signal which is indicative of phase coherence between the signals on the two inputs. A frequency generator has an output coupled with the second input of the phase lock loop and an alarm is actuable in response to the phase locked signal.

The invention also includes the presence sensing detector described in the above system.

27 Claims, 10 Drawing Figures

PRESENCE SENSING DETECTOR AND SYSTEM FOR DETECTING A RECEIVER/TRANSMITTER DEVICE AFFIXED TO AN ARTICLE

BACKGROUND OF THE INVENTION

This invention relates to a presence sensing system and more particularly but not solely to such a system for enabling an alarm to be sounded when a security device is present in a controlled zone.

SUMMARY OF THE INVENTION

It is extremely difficult to prevent pilfering of goods from busy shops. This invention according to one aspect seeks to provide a presence indicating device for attachment to an article which can be detected by a detector when it enters a controlled zone. The presence indicating device can be removed from the article at the payment point. The invention also seeks to provide a detector for sensing the indicating device and a method and a system of presence detection to combat pilfering. The principles of this invention are also applicable to other purposes.

According to one aspect of the invention there is provided a presence sensing system, comprising a detector having a transmitter for transmitting an interrogation signal and a receiver for receiving a presence indicating signal, and a receiver/transmitter device the presence of which is to be detected adapted to receive the interrogation frequency and to transmit said presence signal in response thereto, wherein the detector further comprises a phase lock loop circuit having a first input coupled with the output of the receiver a second input for a reference signal and an output for providing a phase locked signal indicative of phase coherence between the signals on said first and second inputs, a frequency generator having an output coupled with said second input of the phase lock loop, and an alarm coupled with the output of the phase lock loop actuable in response to said phase locked signal.

The receiver/transmitter device may be arranged to effect retransmission of the received signal to form the presence indicating signal or may transmit a presence signal of a frequency different to the frequency of the received signal.

In one form of the invention an active receiver/transmitter device is provided with means for synthesizing the presence indicating signal from the frequency of the received signal. The frequency synthesis may comprise multiplication or division by an integral number.

In order to discriminate between presence indicating signals and spurious signals occurring near the presence indicating frequency, the generated frequency of the detector may comprise a signal derived from the same frequency source as the interrogating signal frequency. The generated frequency may be equal to the interrogating signal frequency or may be a frequency derived therefrom, or a frequency from which the interrogating signal frequency is derived. The comparison is effected by a phase lock loop which provides phase locked signals as a presence sensing signal when the compared signals are in phase coherence.

In an alternative arrangement said generated frequency may be provided by an oscillator having a restricted frequency variation which is controllable by a phase lock loop to lock the oscillator to a received presence indicating signal within said restricted frequency range and provide a phase locked signal as a presence indicating signal when the oscillator and received signal are in phase.

In one particularly convenient form the system is arranged to derive the interrogating signal frequency from a master oscillator by multiplication by an integer and the presence indicating signal from the received frequency by division by the same integer.

The received presence indicating signal may be arranged to actuate an alarm preferably after verification.

The interrogating frequency may be transmitted in pulsed carrier form. In such an arrangement the received pulses may be passed via an integrator to the alarm such that alarm actuation occurs only after receipt of a predetermined number of pulses.

In order to make the system less susceptible to actuation by broad band interference caused by for example lightning or electrical equipment noise in a pulsed transmission arrangement means may be provided for checking the presence of a spurious received signal at the wanted frequency prior to a transmission pulse and for rejecting a following presence indicating signal upon detection of such a spurious signal. Said means for checking the presence of a received spurious signal at the wanted frequency prior to a transmission pulse may comprise a pulse generator actuable by a signal at the wanted frequency in the interval between transmission pulses and said inhibit means comprises a gate circuit having a first input coupled to the output of the pulse generator a second input coupled to the output of the phase lock loop for providing an inhibit signal upon occurrence of signals on both said inputs, and a hold circuit responsive to said inhibit signal to maintain the inhibit signal during the period of the next transmission pulse.

The receiver/transmitter device may be provided with means for providing digitally coded pulses for transmission as the presence indicating signal.

The coding rate of the pulses may be derived from the received frequency by division. The coding may be effected by stepping a register as a function of the received frequency to provide an output on one coding line in turn and by providing a through connection to an output line from preset ones of the coding lines to enable a predetermined code to be routed to the output for modulating a transmit pulse.

The presence indicating device and detector are preferably operable in the inductive communication frequency band between 10 KHz and 150 KHz at which frequency advantageous signal penetration occurs enabling the presence indicating device to be detected even when carried for example inside a bag.

BRIEF DESCRIPTION OF THE DRAWINGS

In order that the invention and its various other preferred features may be understood more easily, embodiments thereof will now be described, by way of example only, with reference to the schematic drawings in which.

DESCRIPTION OF THE PREFERRED EMBODIMENTS

Figure 1:
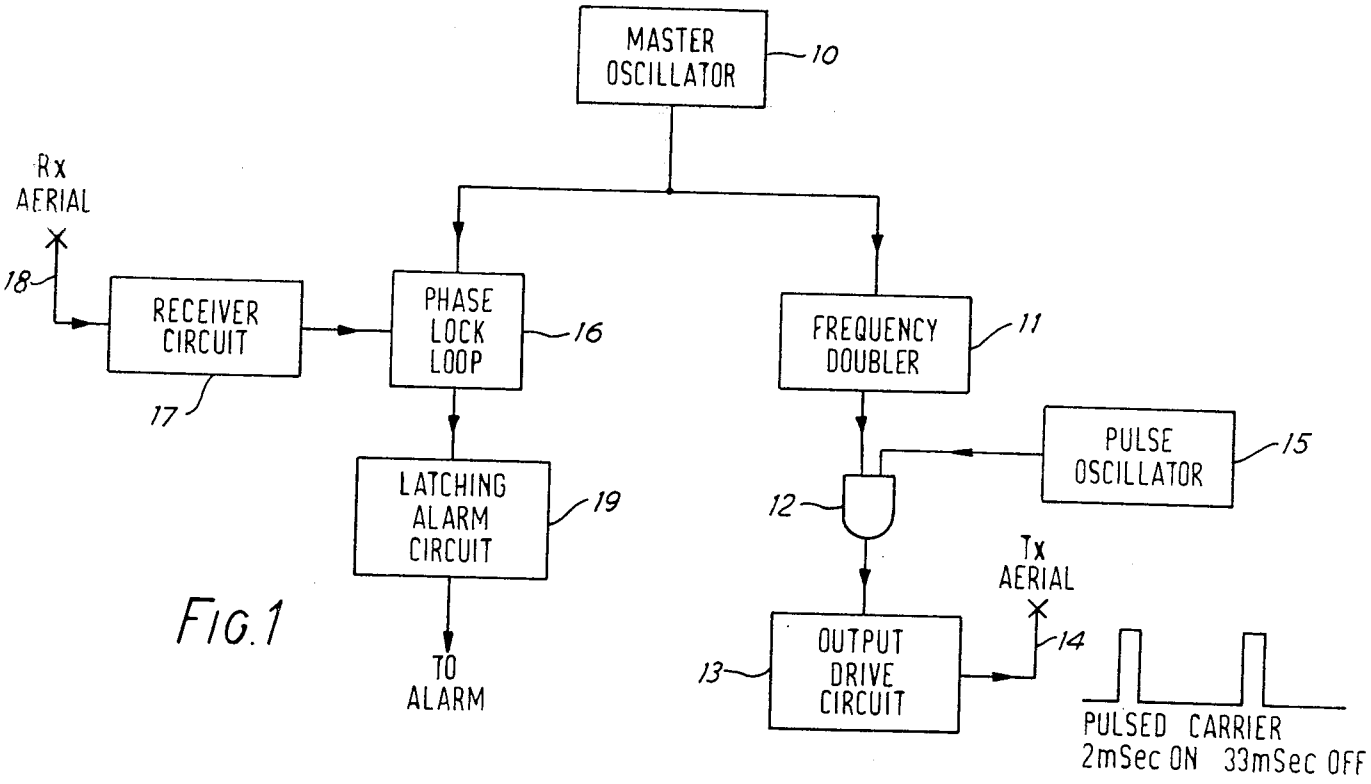
FIG. 1 is a block diagram of a detector circuit constructed in accordance with one aspect of the invention.

Referring now to FIG. 1 the detector circuit comprises a master oscillator 10 which generates a frequency of 66 KHz. The output from the master oscillator is fed to the input of a frequency doubler 11 which provides an output frequency of 132 KHz for transmission. This falls within the frequency band allocated by the Post Office for inductive communication systems in the United Kingdom.

The output of the frequency doubler 11 is fed via an AND circuit 12 to an output drive circuit 13 coupled to a transmitter aerial 14. A second input to the AND gate 12 is coupled to the output of a pulse generator 15 which provides regular pulses of 2 m sec duration spaced apart by 33 m sec. The pulses "enable" the AND gate and cause the output drive circuit to be pulsed with the 132 KHz signal such that a pulsed carrier signal is radiated from the aerial 14.

The output of the master oscillator 10 is coupled to one input of a comparator circuit 16 in the form of a phase lock loop. A second input to the comparator circuit 16 is coupled to the output of a receiver circuit 17 tuned to receive a frequency of 66 KHz and having an aerial 18. An output from the comparator circuit is coupled to the input of an alarm circuit 19 which has an output for connection to an alarm. The alarm circuit is a latching circuit including integrator which is effective to provide a continuous output signal for operating the alarm upon receipt of an output signal from the phase lock loop.

Figure 2:
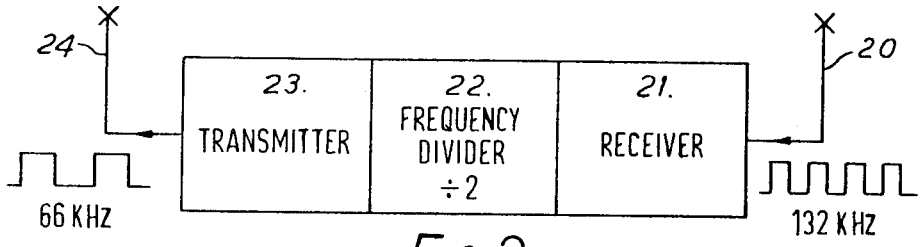
FIG. 2 is a block diagram of a presence indicating device constructed in accordance with another aspect of the invention.

The presence indicating device shown in FIG. 2 is a small security tag of integrated circuit form for attachment to an article and comprises a receiver aerial 20 coupled to a receiver 21 tuned to 132 KHz. The output of the receiver is coupled to a frequency divider 22 which divides the receiver frequency by two which divided frequency is fed to a transmitter 23 where it is transmitted via a transmitter aerial 24.

In use the transmitter aerial 14 is arranged to irradiate a zone to be controlled. When the indicating device of FIG. 2 is present in the irradiated zone it receives the signal divides the signal by two in the divider 22 and transmits the divided signal which is received by the aerial 18.

The comparator 16 compares the received signal with the signal from the master oscillator and a phase locking occurs at both frequencies will be substantially identical. The locking causes the comparator 16 to provide an output signal which actuates the alarm circuit 19. This phase locking of related signals prevents acceptance and operation of the alarm by spurious signals which are not related to the frequency transmitted by the aerial 14.

Figure 3:
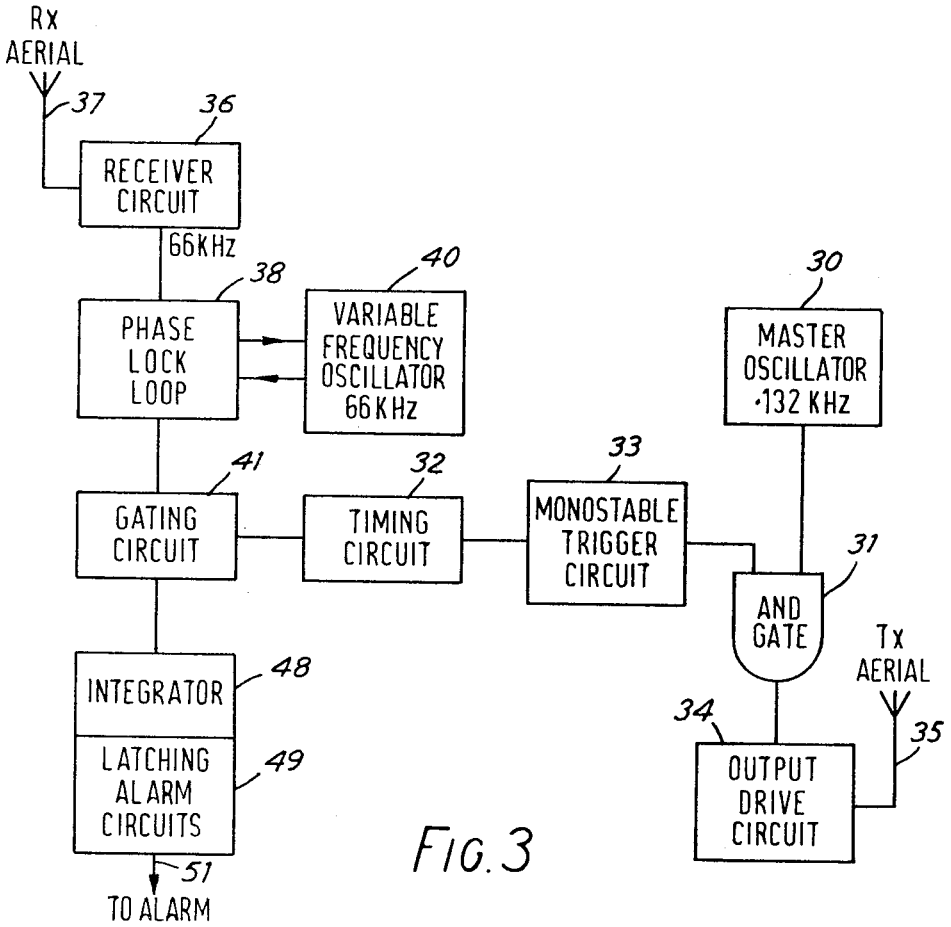
FIG. 3 is a block diagram of an alternative detector circuit constructed in accordance with the invention.

Referring now to FIG. 3, a master oscillator 30 again generates a fixed frequency carrier signal at 132 KHz which forms one input to an AND gate 31.

A timing circuit 32 is coupled to a monostable trigger circuit 33 the output of which is coupled to a second input of the AND gate 31.

The output from the AND gate is a pulsed carrier signal which is coupled to an output drive unit 34 where it is amplified before coupling to a transmitter aerial 35.

A receiver 36 is tuned to detect a signal which is an exact harmonic or sub harmonic of the transmitted frequency (in this particular case 66 KHz) as received by a receive aerial 37.

To improve selectivity of the receiver its output is fed to a phase lock loop 38 which is coupled with an oscillator 40 which has a frequency of approximately 66 KHz but which has a restricted variable frequency range to permit "pulling" into phase coherence in response to a received signal within a predetermined narrow frequency range. This enables the phase lock loop to lock to a wanted signal but to ignore an interfering signal provided it falls outside of the narrow pulling range. In this way the phase lock loop acts as a very high grade filter. The phase lock loop provides an output signal of logic "1" when phase locking occurs.

To guard against the possibility of false alarms caused by wide band noise sources e.g. lightning or electrical machine interference, a gating circuit 41 has been incorporated.

Figure 4:
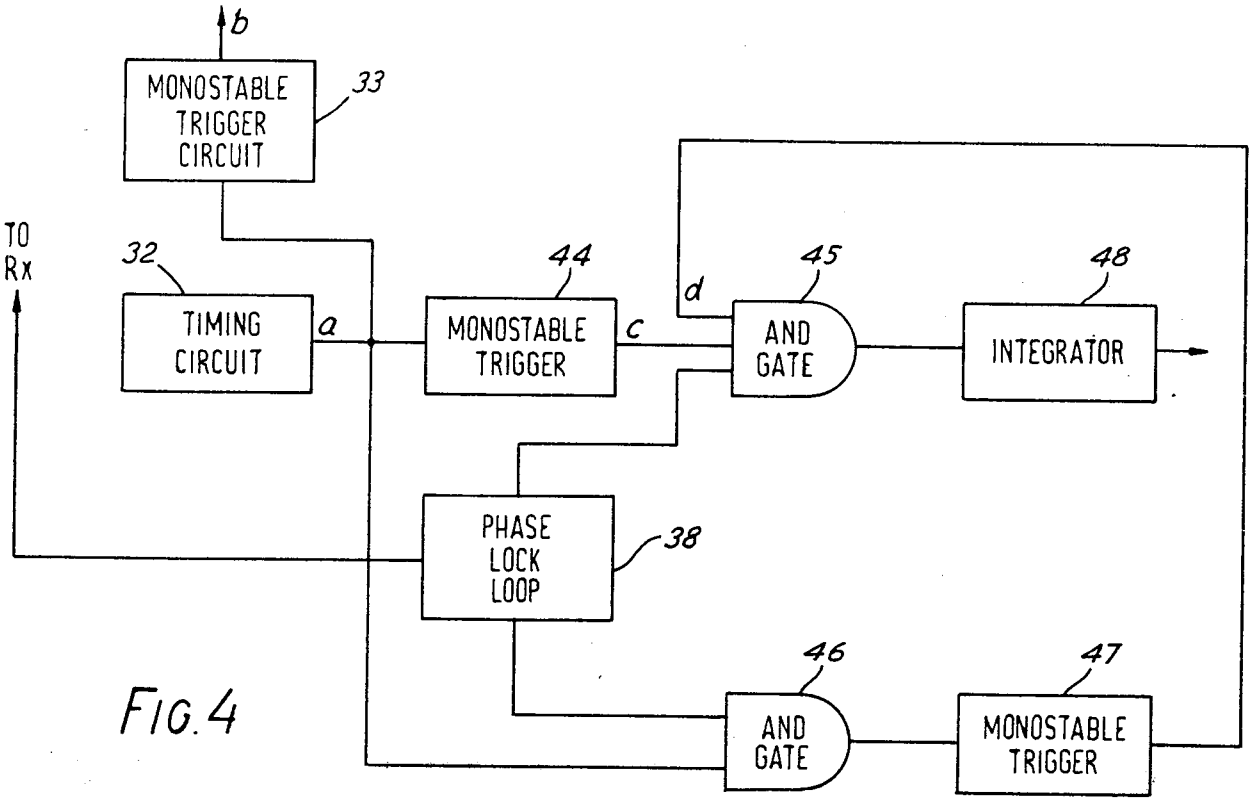
FIG. 4 is a block diagram of the gating circuit employed in FIG. 3.

The gating circuit is shown in greater detail in FIG. 4. The timing circuit 32 forms a pulse repetion generator having an output coupled to the input of the monostable trigger circuit 33 and an output coupled to one input of a two input AND gate 46 and to the input of a trigger circuit 44 the output of which is coupled to one input of a 3 input AND gate 45. The second input of the AND gate 46 is coupled to the output of the phase lock loop 38. The output of the gate 46 is coupled to the input of a monostable trigger circuit 47 which provides a normal output of logic "1" to one input of the gate 45. The third input of the gate 45 is coupled to the output of the phase lock loop 38 and the output of the gate 45 forms an output for feeding an integrator 48 and latching alarm circuits 49 of FIG. 3. The output 51 of the latching alarm circuits 49 is coupled to an alarm.

Figure 5:
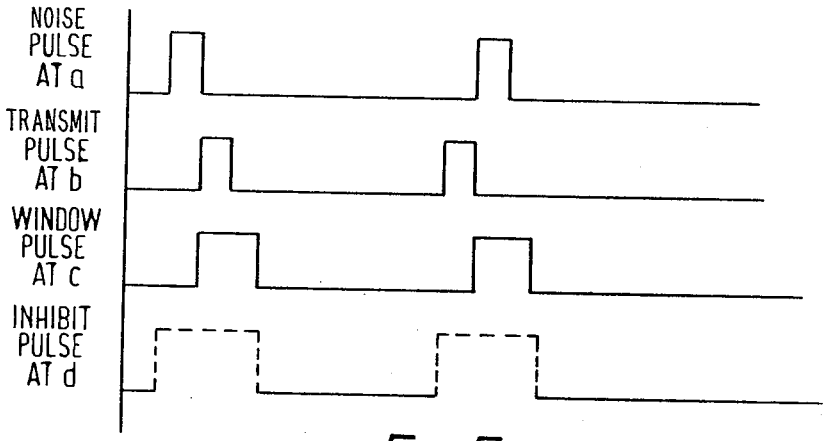
FIG. 5 is a waveform diagram showing the waveforms occurring at points (a), (b), (c) and (d) in the diagram of FIG. 4.

The gating circuit operates as follows and pulse diagrams at points on FIG. 4 are indicated in FIG. 5. The timing circuit 32 controls the generation of monostable trigger circuits 33 and 44 to produce output waveforms a b and c. The timing circuit generates an output immediately prior to the transmit pulse from the monostable trigger circuit 33. If a logic "1" output occurs from the phase lock loop 38 at the same time as a logic "1" pulse from the timing circuit 32 then the gate 46 provides a logic "1" output to the monostable trigger circuit 47 which is triggered to provide a "0" output for a predetermined inhibit period to the gate 45. The inhibit period is long enough to maintain the gate 45 non conductive until after the expiration of the next window pulse (waveform C) and no output is provided from gate 45 to the integrate circuit 48. If however, during the space between pulses no output occurs from the phase lock loop thereby indicating that no spurious interfering signal is present then a "0" output from the gate 46 prevents triggering of the trigger 47 and a "1" is provided thereby at the input of the gate 45. The output pulses from the timing circuit 32 trigger the trigger circuit 44 which provides a window pulse of logic "1" for a duration longer than the transmitted pulse to be routed to the input of the AND gate 45. The phase lock loop locks to the received signal and provides a "1" to the third input of the gate 45 which provides a "1" output to the latching alarm circuit integrator 48 and latching alarm circuit 49. The integrator is arranged to trigger the latching alarm circuit only after a predetermined number of successive pulses have been fed thereto for example three pulses. The window pulse is of longer duration than the transmitted pulse in order to accommodate the delay in turn off time of the output stage of the phase lock loop.

Figure 9:
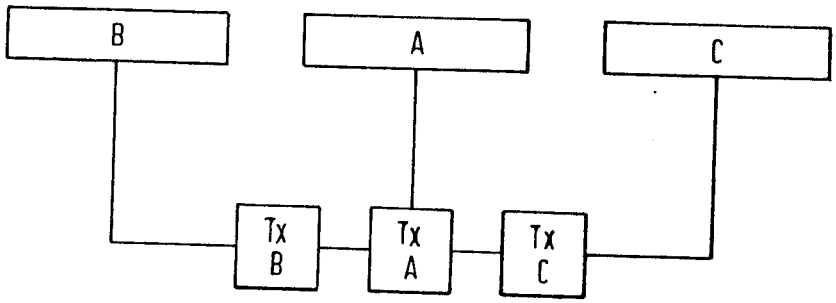
FIG. 9 is a block diagram showing a presence sensing system arranged to survey three adjacent areas.
Figure 10:
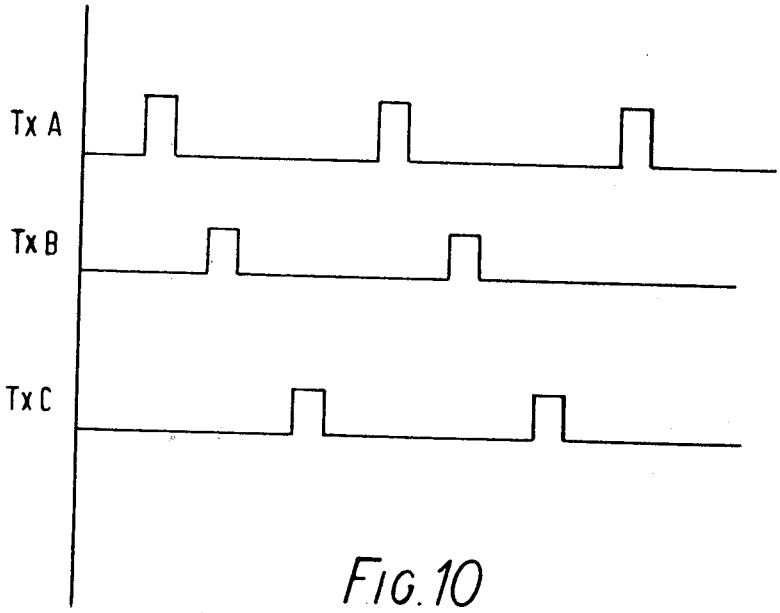
FIG. 10 is a waveform diagram showing the relationship between transmitted pulses provided by the three transceivers in the arrangement of FIG. 10.

By the use of synchronised pulsed carrier transmit pulses it is possible to instal a number of controlled exits immediately adjacent to one another. As an example consider the multiple exit at FIG. 9 with transmitter aerials A B and C connected to their respective transceivers. If the transceiver to aerial A acts as a master to slave transceivers B and C, the transmit pulses can be synchronised as shown at FIG. 10. With this arrangement, interference from adjacent systems is eliminated.

A further enhancement to the system of FIGS. 3 and 4 is to modify the operation of the phase lock loop in a manner similar to that of FIG. 1. This is achieved by removing from the circuit the variable frequency oscillator 40 and instead injecting into the phase lock loop a 66 KHz reference signal which is derived via a dividing circuit directly from the local oscillator. The effect is to produce a highly selective circuit, since the phase lock loop will only produce an output when the received signal is in phase and at the same frequency as the reference frequency.

Figure 6:
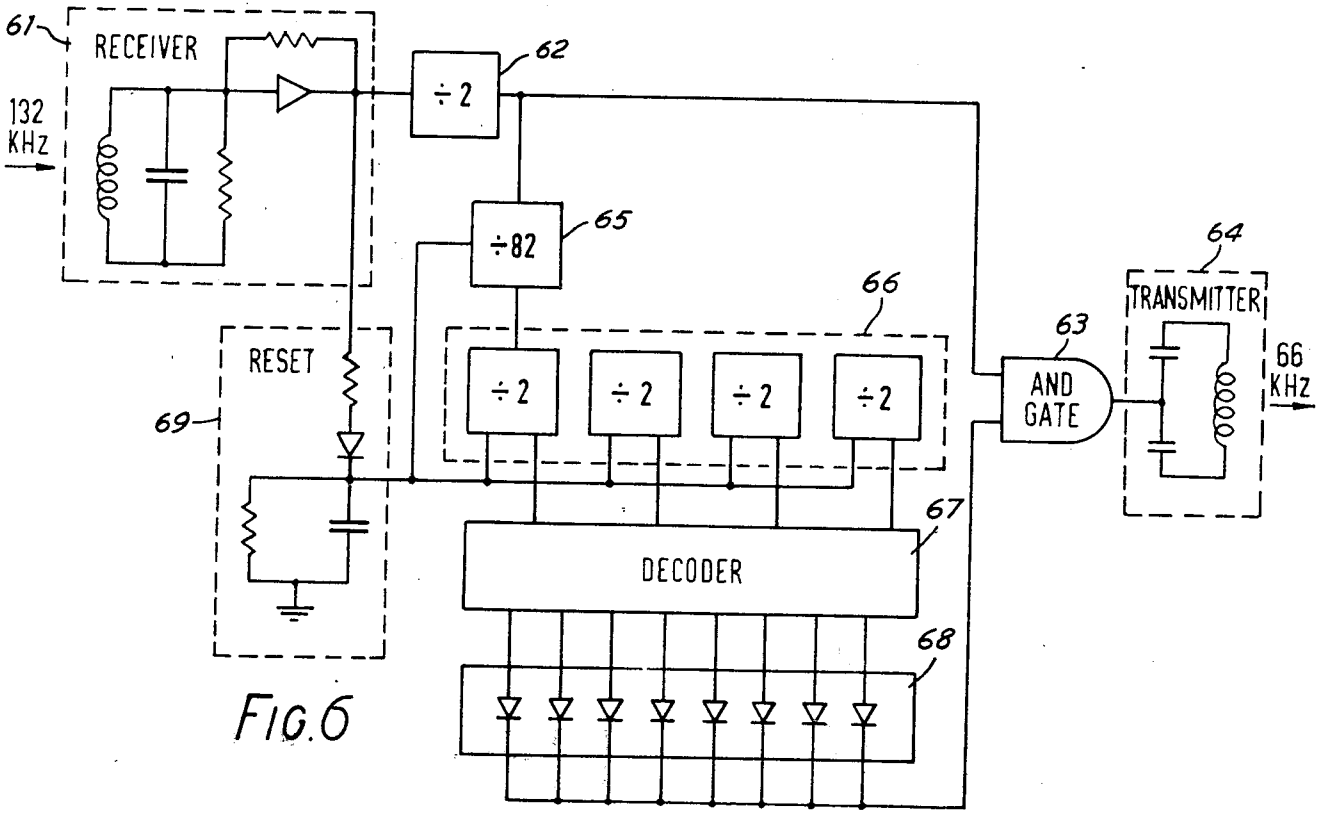
FIG. 6 is a block diagram of a presence indicating device provided with a coder for coding a signal before transmission.

The drawing of FIG. 6 shows a refinement of the presence indicating device which enables a preset identifying code to be transmitted to enable identification of individual tags in the detector.

In this arrangement a receiver 61 is coupled to a coding circuit and the received signal is used as a clock for the coding. The output of the receiver is coupled via a divide by 2 circuit 62 to one input of a two input AND gate 63 the output of which is coupled to a transmitter 64.

The output of the circuit 62 is connected to the input of a divide by 82 network 65 the output of which is coupled to a four bit binary counter 66. The outputs of the counter 66 are coupled to a decimal decoder 67 which provides an output on a particular one of eight output lines corresponding to each of the binary codes. Each of the eight output lines is coupled via a diode of a data coding chip 68, which forms a read only memory to a common output which is coupled to the other input of the AND gate 63. Some of the diodes are "blown" in the conventional manner to provide a unique eight bit serially coded pulse train in response to stepping of the decoder 67.

A reset circuit 69 is coupled to the divide by 82 network and binary counter 66 and is fed from the receiver and is arranged to reset the divider and counter in the absence of a received signal.

On receipt of a pulse of 132 KHz signal from the transceiver, a 66 KHz carrier signal derived from the divider 62 forms one input to the 2 input AND gate 63. Simultaneously the divider circuit 66 steps the counter 66 at intervals of approximately 2.5 m sec. The outputs from the counter chain are converted from binary into decimal by the decoder. The eight sequential outputs of 2.5 m sec duration each from the decoder provide the means of reading the tag code from the single read only memory formed by the data coding chip 68. The eight bit serial coded pulse train forms the second input to the two input AND gate 63 which provides an output 66 KHz carrier pulsed in accordance with the particular code of the tag. It will be appreciated that the detectors can be provided with a simple register which will respond to the coded carrier and provide an indication of the code for identification purposes.

Although only an eight bit code has been described, codes employing more or fewer bits can be employed, and different pulse lengths can be employed.

Figure 7:
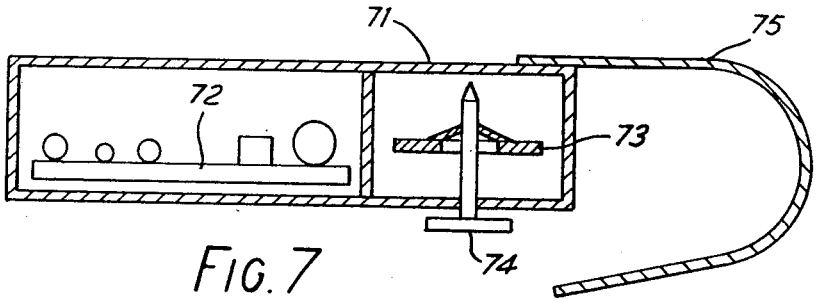
FIG. 7 is a cross sectional view of a presence indicating device in the form of a tag.

FIG. 7 shows a cross sectional view of a tag which comprises a moulded housing 71 with an encapsulated circuit board 72 with the receiver/transmitter and associated divider/coding circuitry at one end and a locking device 73 at the other end for receiving and securing a headed fastener 74 inserted from one side. The fastener is passed through a garment into the locking device to secure the assembly on an article the unauthorised removal of which is to be detected. The housing is also provided with a nylon strap 75 having holes therethrough which can serve to secure the device to other articles by passing the strap through a hole therein and passing the headed fastener 74 through a hole in the strap and into the locking device 73. The fastener 74 can only be removed from the locking device with a special tool.

Figure 8:
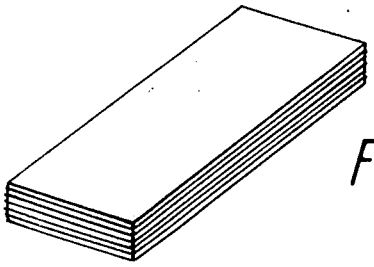
FIG. 8 is a perspective view of a transmitter aerial coil for the detector circuit.

The detector employs a transmit aerial as shown in FIG. 8 wound on a flat hollow rectangular former of approximate dimensions 100 cms by 18 cms. The coil is connected in parallel with a capacitor and a single turn coupling coil is transformer coupled to the output of the transmitter. Tuning is effected by distorting the former and the former when tuned is filled with foam to retain its shape. This enables the complete aerial to be recessed into the floor or suspended overhead and there is no requirement for the advice transmitter/receiver to be brought in the immediate vicinity of or to pass through an inductive loop.

The receiver aerial is a tuned ferrite rod.

The active presence indicating receiver/transmitter device may be powered by any suitable means e.g. by internal replacable or rechargeable batteries by self energisation from the received signal or by means of an integral photo-electric or thermo-electric generator.

The presence indicating device which may be in the form of a security tag may be arranged to be securely attachable to an article by any suitable form of locking means e.g. a key actuated lock to enable removal only by authorised personnel at for example a sales point. The indicating device may be provided with means for switching off when removed from the article. Such means may conveniently be actuated upon release of the locking means.

The system is particularly advantageous in that:

(a) The frequency of operation is in the induction communication range. This means that the presence indicating security tag is largely insensitive to shielding and screening.

(b) The tag is active. This enables a much greater range to be achieved than would be the case with a passive tag system.

(c) The tag may be arranged to transmit at an exact sub harmonic of the fundamental frequency. This reduces the possibility of spurious alarms.

(d) The output drive circuit of the transmitter of the detector is pulsed thus reducing overall power consumption and extending the life of circuit components.

(e) Alternative possibilities for more restricted coding of tags are to code by different transmission frequencies or by different pulse rates or different pulse to space ratios.

There are various modifications of the system which fall within the scope of this invention for example:

1. The presence indicating tag circuit could be arranged to transmit at the same frequency as the received signal provided suitable shielding is provided between the transmitter aerial and receiver aerial. In this case the transmitted signal could be compared directly with the received signal in the comparator.

2. Instead of a frequency doubler 11 as employed in FIG. 1 a circuit which multiplies or divides the master oscillator frequency by an integer may be provided. The master oscillator frequency will of course need to be changed if the transmitted frequency is to be 132 KHz.

3. The signal received by the receiver circuit 17 can be processed by multiplying or dividing by an integer in order to convert it to a frequency suitable for comparison in the comparator 16 with the master oscillator frequency, the output frequency for transmission by the output drive circuit 13 or any frequency derived therefrom by multiplication or division by an integer. Similarly, a frequency derived from the master oscillator frequency or the output frequency for transmission by multiplication or division by an integer, could be compared with a signal as received by the receiver 17 provided the correct relationships for correlation have been established in the transmission and reception circuits.

It will be appreciated that the invention has application to purposes other than security of goods in shops. The system is suitable for use for example in connection with the opening of doors upon approach of a person or vehicle provided with a suitable presence indicating tag, for identifying articles bearing such tags passing along a production line, for clocking in and out of factories for security of keys in hotels where each key could be fitted with a tag, for operating an alarm at hotel doorways, and many other purposes.

It will be understood that the above description of the present invention is susceptible to various modification changes and adaptations.

What is claimed is:

1. A presence sensing system, comprising a detector having a transmitter for transmitting an interrogation signal and a receiver for receiving a presence indicating signal, and a receiver/transmitter device the presence of which is to be detected adapted to receive the interrogation frequency and to transmit said presence indicating signal in response thereto, wherein the detector further comprises a phase lock loop circuit having a first input coupled with the output of the receiver a second input for a reference signal and an output for providing a phase locked signal indicative of phase coherence between the signals on said first and second inputs, a frequency generator having an output coupled with said second input of the phase lock loop, and an alarm coupled with the output of the phase lock loop actuable in response to said phase locked signal.

2. A system as claimed in claim 1, wherein the receiver/transmitter device is arranged to transmit a presence indicating signal of a frequency different from the frequency of the received interrogation signal.

3. A system as claimed in claim 2, wherein the receiver/transmitter device is provided with means for synthesizing the presence indicating signal from the frequency of the received interrogation signal.

4. A system as claimed in claim 1, wherein the receiver-transmitter device comprises coding means for providing digitally coded pulses for transmission as the presence indicating signal.

5. A system as claimed in claim 4, including a divider having an input coupled with the receiver output of the receiver/transmitter device and an output for providing pulses at a coding rate derived from the received frequency by division.

6. A system as claimed in claim 1 comprising a master oscillator and wherein the interrogation signal is derived from the master oscillator by multiplication by an integer and the presence indicating signal is derived from the received interrogation signal by division by the same integer.

7. A system as claimed in claim 1, further comprising an integrating circuit disposed prior to said alarm for delaying alarm actuation until presence signals of predetermined duration have been received.

8. A system as claimed in claim 1 actuable in the inductive communication band.

9. A presence sensing system as claimed in claim 1, wherein the transmitter of the detector has an aerial whereby there is no requirement for the active transmitter/receiver device to be brought into the immediate vicinity of or to pass through an inductive loop.

10. A system as claimed in claim 1, wherein the detector comprises pulse generating means having an output pulsed signal and a gating means having a first input coupled to the output of the pulse generating means a second input coupled to the interrogation signal and an output coupled to the transmitter output which gating means is arranged to provide an output of pulsed carrier form.

11. A system as claimed in claim 10, wherein the detector comprises means for checking for the presence of a spurious received signal at the wanted frequency prior to the transmission of a pulse and for providing an inhibit signal and inhibit means responsive to said inhibit signal for rejecting a following presence indicating signal.

12. A system as claimed in claim 11, wherein the inhibit means comprises a gate circuit having a first input coupled to the output of the pulse generating means, a second input coupled to the output of the phase lock loop and an output for providing an inhibit signal upon occurrence of signals on both said inputs and a hold circuit responsive to said inhibit signal to maintain the inhibit signal during the period of the next transmission pulse.

13. A system as claimed in claim 10, comprising a plurality of said detectors wherein the gating means are synchronised to transmit carrier pulses sequentially at different time periods.

14. A system as claimed in claim 1, wherein the frequency generator of the detector is arranged to derive the reference signal from the same frequency source as the interrogating signal frequency.

15. A system as claimed in claim 1, wherein said frequency generator comprises an oscillator having a restricted frequency variation controllable by said phase lock loop in response to a received presence indicating signal to lock the oscillator to a received signal within said restricted frequency range and provide said phase locked signal.

16. A system as claimed in claim 1, including securing means on the receiver/transmitter device for permitting releasable securement of the device on an article.

17. A presence sensing system comprising a presence sensing detector and an active presence indicating transmitter/receiver device provided with means for permitting secure attachment to an article wherein the presence sensing detector comprises an oscillator having an output for providing an interrogation frequency for transmission at said output; a gating circuit having first and second inputs and an output, the first input being coupled to the output of the oscillator; a repetitive pulse generator coupled to the second input of the gating circuit for gating pulses of said frequency for transmission to the output of the gating circuit; a transmitter coupled with the output of the gating circuit; a receiver tuned to a presence indicating frequency different from said frequency for transmission and providing an output; a phase lock loop having an input coupled to the output of the receiver, a second input for a reference signal and an output for providing a phase locked signal indicative of phase coherence between signals on said first and second inputs; a variable frequency oscillator coupled to said second input of the phase lock loop to form said reference signal which oscillator is controllable in response to the signal from the receiver to lock said phase lock loop; and an alarm generator actuable in response to said phase locked signal and wherein said active presence indicating transmitter/receiver device comprises a receiver tuned to said frequency for transmission of the presence sensing detector and for providing an output; synthesizing means having an input coupled with the output of the receiver and an output for providing said presence indicating frequency different from said received frequency and synthesized therefrom; and a transmitter coupled with the output of the synthesizer for transmitting the presence indicating frequency.

18. A presence sensing system comprising a presence sensing detector and an active presence indicating transmitter/receiver device provided with means for permitting secure attachment to an article wherein the presence sensing detector comprises a master oscillator having an output for providing a frequency for transmission at said output; a gating circuit having first and second inputs and an output, the first input being coupled to the output of the master oscillator; a repetitive pulse generator coupled to the second input of the gating circuit for gating pulses of said frequency for transmission to the output of the gating circuit; a transmitter coupled with the output of the gating circuit; a receiver tuned to a presence indicating frequency different from said frequency for transmission and providing an output; a phase lock loop having a first input coupled to the output of the receiver a second input for a reference signal and an output for providing a phase locked signal indicative of phase coherence between signals on said first and second inputs and synthesizing means having an input coupled to the output of the master oscillator and an output coupled to the second input of said phase lock loop to provide said reference signal to permit locking of the phase lock loop on receipt of a phase coherent signal; and an alarm generator actuable in response to said phase locked signal and wherein said active presence indicating transmitter/receiver device comprises a receiver tuned to said frequency for transmission of the presence sensing detector and for providing an output; synthesizing means having an input coupled with the output of the receiver and an output for providing said presence indicating frequency different from said received frequency and synthesized therefrom; and a transmitter coupled with the output of the synthesizer for transmitting the presence indicating frequency.

19. A detector for a security system comprising generating means for generating a signal for transmission, a transmitter coupled with the generating means for transmitting the transmission signal for receipt by a presence indicating security device, a receiver for receiving a signal from the security device in response to the transmission frequency, and a phase lock loop circuit having first and second inputs and an output, the first input of which is coupled with the output of the receiver; a frequency generator having an output coupled with the second input of the phase lock loop the output of the phase lock loop providing on said output a phase locked signal indicative of phase coherence between the inputs on said first and second inputs and an alarm coupled with the output of the phase lock loop actuable in response to said phase locked signal.

20. A detector as claimed in claim 19, wherein said generating means comprises a master oscillator and wherein said frequency generator comprises a synthesizer having an input coupled with said master oscillator adapted to provide an output to said comparator means that is derived from the master oscillator frequency.

21. A detector as claimed in claim 20, comprising gating means coupled between said generating means and said transmitter; pulse generating means coupled with the gating means arranged to provide an output from the gating means of pulsed carrier form; checking means coupled with the output of said comparator means for checking for the presence of a spurious received signal at the wanted frequency prior to the transmission of a pulse and for providing an inhibit signal in response to detection of such a spurious signal, and inhibit means responsive to said inhibit signal for rejecting a following presence indicating signal.

22. A detector as claimed in claim 21, wherein said means for checking for the presence of a spurious signal comprises inhibit circuitry actuable by a signal at the wanted frequency in the interval between transmission pulses, and said inhibit means comprises a gate circuit having a first input coupled to the output of the pulse generating means and a second input coupled to the output of the phase lock loop for providing an inhibit signal upon occurrence of signals on both said inputs, and a hold circuit responsive to said inhibit signal to maintain the inhibit signal during the period of the next transmission pulse.

23. A detector as claimed in claim 19, wherein said frequency generator comprises an oscillator having a restricted frequency variation controllable by said phase lock loop in response to a received presence indicating signal to lock the oscillator to a received presence indicating signal within said restricted frequency range.

24. A detector as claimed in claim 23, comprising gating means coupled between said generating means and said transmitter; pulse generating means coupled with the gating means arranged to provide an output from the gating means of pulsed carrier form; checking means coupled with the output of said comparator means for checking for the presence of a spurious received signal at the wanted frequency prior to the transmission of a pulse and for providing an inhibit signal in response to detection of such a spurious signal, and inhibit means responsive to said inhibit signal for rejecting a following presence indicating signal.

25. A detector as claimed in claim 24, wherein said means for checking for the presence of a spurious signal comprises inhibit circuitry actuable by a signal at the wanted frequency in the interval between transmission pulses, and said inhibit means comprises a gate circuit having a first input coupled to the output of the pulse generating means and a second input coupled to the output of the phase lock loop for providing an inhibit signal upon occurrence of signals on both said inputs, and a hold circuit responsive to said inhibit signal to maintain the inhibit signal during the period of the next transmission pulse.

26. A detector as claimed in claim 25, wherein the transmitter of the detector has an aerial whereby there is no requirement for the active transmitter/receiver device to be brought into the immediate vicinity of or to pass through an inductive loop.

27. A detector as claimed in claim 19, comprising a plurality of said detectors wherein the gating means are synchronised to transmit carrier pulses sequentially at different time periods.

* * * * *